US011505347B2

(12) United States Patent
Piazzaroli

(10) Patent No.: US 11,505,347 B2
(45) Date of Patent: Nov. 22, 2022

(54) DOSING AND PACKAGING APPARATUS FOR LONG PASTA

(71) Applicant: Altopack S.p.A., Altopascio (IT)

(72) Inventor: Massimo Piazzaroli, Castelnuovo di Garfagnana (IT)

(73) Assignee: ALTOPACK S.P.A., Altopascio (IT)

( * ) Notice: Subject to any disclaimer, the term of this patent is extended or adjusted under 35 U.S.C. 154(b) by 0 days.

(21) Appl. No.: 17/229,963

(22) Filed: Apr. 14, 2021

(65) Prior Publication Data

US 2021/0323700 A1 Oct. 21, 2021

(30) Foreign Application Priority Data

Apr. 14, 2020 (IT) ..... 202020000001588

(51) Int. Cl.

| | |
|---|---|
| ***B65B 19/34*** | (2006.01) |
| ***B65B 37/08*** | (2006.01) |
| ***B65B 43/52*** | (2006.01) |
| ***B65B 1/32*** | (2006.01) |
| ***B65B 1/10*** | (2006.01) |

(52) U.S. Cl.

CPC ..... *B65B 19/34* (2013.01); *B65B 1/32* (2013.01); *B65B 37/08* (2013.01); *B65B 43/52* (2013.01); *B65B 1/10* (2013.01)

(58) Field of Classification Search

CPC .. B65B 1/10; B65B 1/32; B65B 19/34; B65B 37/08; B65B 43/52; G01G 13/00

USPC ..... 53/502, 167, 566, 249–253

See application file for complete search history.

(56) References Cited

U.S. PATENT DOCUMENTS

| | | | | | |
|---|---|---|---|---|---|
| 2,299,636 | A | * | 10/1942 | Mansbendel | G01G 13/00 198/614 |
| 2,509,836 | A | * | 5/1950 | Muskat | B65B 1/10 222/169 |
| 3,056,485 | A | * | 10/1962 | Liberty | B65B 19/34 53/529 |
| 3,556,355 | A | * | 1/1971 | Ruiz | B65B 37/08 222/368 |
| 4,531,597 | A | * | 7/1985 | Focke et al. | B65B 37/08 177/84 |

(Continued)

FOREIGN PATENT DOCUMENTS

| | | | | |
|---|---|---|---|---|
| EP | 680879 | A1 * | 11/1995 | B65B 1/34 |
| EP | 1129948 | A1 * | 9/2001 | B65B 37/20 |

(Continued)

*Primary Examiner* — Stephen F. Gerrity

(74) *Attorney, Agent, or Firm* — Jacobson Holman PLLC

(57) ABSTRACT

A dosing and packaging apparatus (1) for long pasta comprising at least one dosing unit (2) and a cartoner (3) below the dosing unit. The dosing unit comprises a weighing device (21, 22) for doses of long pasta, and the cartoner comprises trays (31, 33) for containing doses of weighed long pasta, a chain conveyor (32) for horizontally moving the trays, and a device for forming and filling cartons with the doses of long pasta from the trays. The dosing unit comprises a rotor (23) with more than one compartment (25) for pouring doses of weighed long pasta directly into the trays. The rotation of the rotor and the horizontal motion of the trays are synchronized so that each compartment pours a dose of weighed long pasta into a respective tray placed immediately below the rotor.

5 Claims, 1 Drawing Sheet

(56) References Cited

U.S. PATENT DOCUMENTS

| | | | | |
|---|---|---|---|---|
| 4,617,974 | A * | 10/1986 | Focke et al. | B65B 1/10 198/442 |
| 5,377,727 | A | 1/1995 | Ueda et al. | |
| 5,636,498 | A * | 6/1997 | Belanger et al. | B65B 19/34 53/500 |
| 6,444,926 | B1 * | 9/2002 | Ricciardi, Sr. | G01G 13/246 177/83 |
| 9,352,859 | B2 * | 5/2016 | Librio | B65B 1/10 |
| 2021/0163160 | A1 * | 6/2021 | Bood et al. | B65B 37/08 |

FOREIGN PATENT DOCUMENTS

| | | | | |
|---|---|---|---|---|
| EP | 3326922 | A1 * | 5/2018 | B65B 19/34 |
| EP | 3142927 | | 8/2018 | |

* cited by examiner

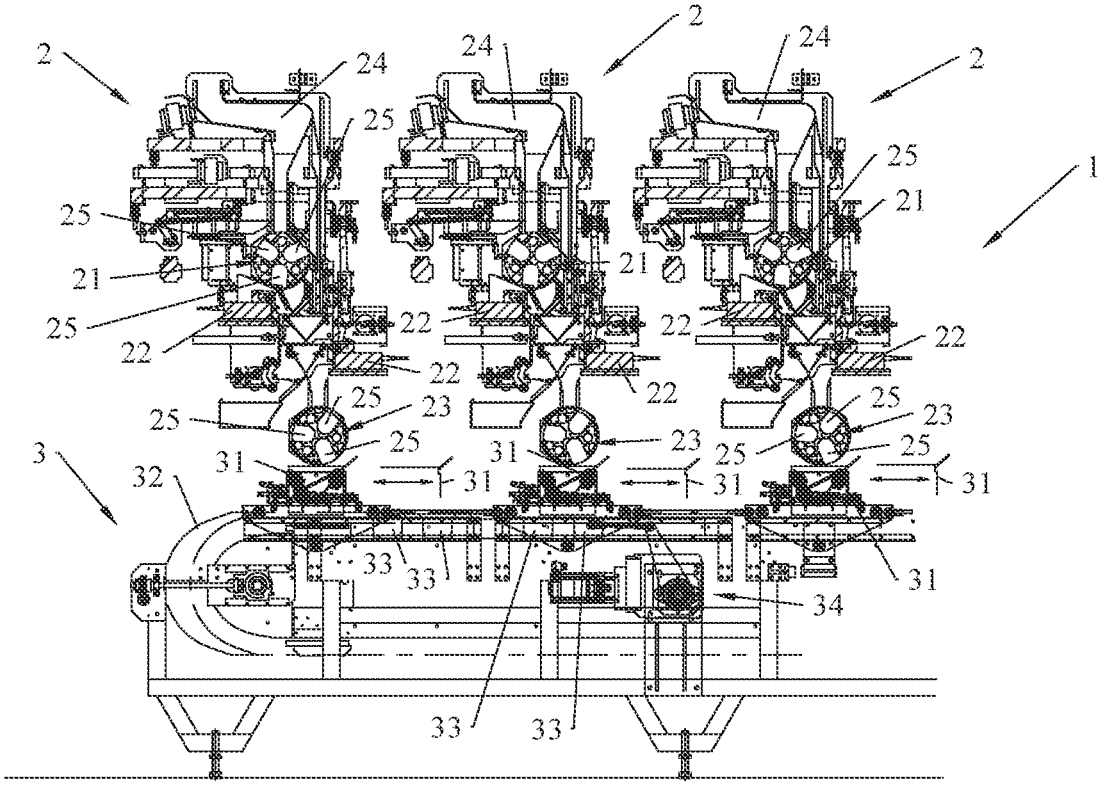
2
24
25
21
22
23
31
32
33
34
3
1

DOSING AND PACKAGING APPARATUS FOR LONG PASTA

BACKGROUND OF THE INVENTION

The present invention relates to a dosing and packaging apparatus for long pasta.

The step of loading long pasta into cartons of a predetermined size is very problematic.

Indeed, it is necessary to insert a previously weighed dose of pasta into a small-sized compartment; if the operation is not done carefully, the long pasta will break.

The cartons are containers moved horizontally by a chain conveyor arranged under a dosing machine.

The present applicant is the holder of the European patent EP-3142927B1, describing a dosing machine comprising a three-compartment rotor able to feed two load cells in series. Downstream of the last load cell, there is a synchronization hopper for pouring the dose of pasta into trays of a chain conveyor of a cartoner, namely a machine which is able to form, handle, and load cartons with long pasta, and then possibly box it.

Disadvantageously, although the weighing is accurate, the pouring through the hopper is too rapid due to the change in height with consequent breakage of some of the dosed long pasta.

U.S. Pat. No. 5,377,727 describes a granular material dosing machine comprising a rotor and a hopper downstream of said rotor which is provided with a plurality of pairs of compartments at 180° to one another. Each pair of compartments loads a container placed at the hopper outlet. The machine is not suitable for dosing long pasta and there is still the problem of the pasta falling after the rotor along the hopper.

SUMMARY OF THE INVENTION

It is the object of the present invention to provide a dosing and packaging apparatus for long pasta, which avoids the breakage of the long pasta.

It is a further object of the present invention that said apparatus ensures high productivity, in particular it is required that the dosage into cartons and the handling of the cartons are synchronized.

It is a still further object of the present invention that said apparatus uses technical means which are simple, compact, and easy to adjust.

According to the invention, said and further objects are achieved by a dosing and packaging apparatus for long pasta comprising at least one dosing unit and a cartoner below the dosing unit, in which

- the dosing unit comprises weighing means for doses of long pasta, and
- the cartoner comprises trays for containing doses of weighed long pasta, a chain conveyor for horizontally moving the trays, and a device for forming and filling cartons with the doses of long pasta from the trays, characterized in that

- the dosing unit comprises a rotor with more than one compartment for pouring doses of weighed long pasta directly into the trays,
- the rotation of the rotor and the horizontal motion of the trays being synchronized so that each compartment pours a dose of weighed long pasta into a respective tray placed immediately below the rotor.

Advantageously, the rotor is flush with the top opening of the trays so as to avoid the breakage of the long pasta falling into the trays and to facilitate the synchronism between the rotation of the rotor and the translation of the trays.

DESCRIPTION OF THE DRAWING

These and other features of the present invention will become more apparent from the following detailed description of a practical embodiment thereof, shown by way of non-limiting example in the accompanying drawing, in which:

The Fig. shows a vertical section view of an apparatus according to the present invention.

DESCRIPTION OF THE INVENTION

A dosing and packaging apparatus 1 for long pasta comprises a plurality of dosing units 2 and a cartoner 3 below said dosing unit 2.

Each dosing unit 2 comprises a first rotor 21 for dosing long pasta into two load cells 22 in series, and a second rotor 23 for pouring doses of weighed long pasta into synchronization trays 31 of the cartoner 3.

The long pasta falls into the first rotor 21 through a hopper 24.

The second rotor 23 is immediately downstream of the second load cell 22, thus limiting the fall height.

The cartoner 3 comprises a chain conveyor 32 which moves the trays 33 where the dosed pasta is deposited, which, in turn, is loaded from the synchronization trays 31, and a device for forming and filling cartons (not shown in the Fig.).

The synchronization trays 31 are able to move back and forth in the sliding direction of the underlying trays 33 to adjust the rotational speed of the rotors 21, 23 to the translation speed of the trays 33 (see the arrows next to the synchronization trays 31 in FIG. 1, wherein the synchronization trays 31 are also partially depicted in a second position translated with respect to a first position).

The synchronization trays 31 move following the trays 33 by virtue of belt means 34 of the cartoner 3.

Said device is provided with pushers for transferring the doses of weighed long pasta from the trays 33 moved by the chain conveyor 32 to the respective cartons (not shown in the Fig.). The pushers work horizontally, orthogonally to the translation direction of cartons and trays.

The formed and open cartons move parallel to the synchronization trays 31 and to trays 33 by virtue of a second chain conveyor parallel to the chain conveyor 32.

The pushers translate horizontally with the cartons and trays 33 but are also capable of translating orthogonally to said sliding direction of the cartons and trays 33 so as to transfer the long pasta from the trays 33 to the cartons, both of which are moving, by pushing the long pasta at one end thereof. The carton is then closed and boxed.

The rotation speed of the rotors 21, 23, and in particular of the second rotor 23, is synchronized with the horizontal translation speed of the synchronization trays 31 so as to fill the trays 33 moved continuously in series by the chain conveyor 32.

Advantageously, the synchronization trays 31 are immediately below the second rotors 23, flush with the top opening of the synchronization trays 31, so as to avoid the breakage of the long pasta falling into the synchronization trays 31 and to facilitate the synchronism between the rotation of the second rotors 23 and the translation of the synchronization trays 31, which by translating follow the trays 33 to unload the product in phase.

The Fig. shows rotors 21, 23 with three compartments 25, but the number of compartments 25 may vary according to the required production speed and the dose of long pasta to be inserted into each carton.

The three compartments 25 per rotor 21, 23 are preferred because the production speed, the carton size and the need to avoid breakage are balanced: an excessive speed would still cause breakages regardless of the limited fall height between the second rotor 23 and the synchronization tray 31.

Alternatively, the apparatus 1 may be provided with dosing units 2 with a different weighing system, namely without the first rotor 21. On the other hand, the presence of the second rotor 23 which rotates flush with the top opening of the synchronization trays 31 is essential.

The apparatus 1 may be also provided with a single dosing unit 2 in the case of a limited size plant for a small production.

Alternatively, the second rotor 23 can pour the long pasta directly into the trays 33 moved by the chain conveyor 32, i.e., without the synchronization trays 31, the presence of which is however to be preferred to have a more precise, faster and more efficient filling.

The invention claimed is:

1. A dosing and packaging apparatus for long pasta comprising at least one dosing unit and a cartoner below the dosing unit, wherein the dosing unit comprises weighing means for doses of long pasta, and the cartoner comprises trays for containing doses of weighed long pasta, a chain conveyor for horizontally moving the trays, the cartoner forms and fills cartons with the doses of long pasta from the trays, wherein the dosing unit comprises a rotor with more than one compartment for pouring doses of weighed long pasta directly into the trays, the rotation of the rotor and the horizontal motion of the trays being synchronized so that each compartment pours a dose of weighed long pasta into a respective tray placed immediately below the rotor.

2. The apparatus according to claim 1, wherein the cartoner comprises synchronization trays for containing doses of long pasta poured by the rotor and for synchronizing a subsequent unloading of long pasta into underlying trays moved by the chain conveyor, the synchronization trays being suitable for moving horizontally following the underlying trays moved by the chain conveyor.

3. The apparatus according to claim 1, wherein the dosing unit comprises a further rotor for dosing the long pasta into at least one load cell, wherein the rotor for pouring doses of weighed long pasta into the trays of the cartoner is immediately downstream of the load cell.

4. The apparatus according to claim 1, wherein the rotor has three compartments.

5. The apparatus according to claim 1, wherein there are a plurality of dosing units above the cartoner.

* * * * *